United States Patent [19]

Stäbler et al.

[11] 4,449,448

[45] May 22, 1984

[54] DOUBLE BAND PRESS

[75] Inventors: Gerhard Stäbler, Murr; Konrad Schermutzki, Remseck, both of Fed. Rep. of Germany

[73] Assignee: Santrade Ltd., Luzern, Switzerland

[21] Appl. No.: 421,061

[22] Filed: Sep. 22, 1982

[30] Foreign Application Priority Data

Oct. 13, 1981 [DE] Fed. Rep. of Germany ..... 3140548

[51] Int. Cl.[3] ..... B30B 3/00

[52] U.S. Cl. ..... 100/153; 100/154

[58] Field of Search ..... 100/153, 154, 118; 198/628, 779; 425/371

[56] References Cited

U.S. PATENT DOCUMENTS

| | | | |
|---|---|---|---|
| 2,899,041 | 8/1959 | Saint-Andre | 198/779 |
| 3,878,027 | 4/1975 | Troutner | 425/371 |
| 3,948,021 | 4/1976 | Buck, Jr. et al. | 100/153 |
| 3,948,718 | 4/1976 | Mosburger | 100/153 |
| 3,973,483 | 8/1976 | Appenzeller | 100/153 |
| 4,271,960 | 6/1981 | Chalich | 198/779 |
| 4,334,468 | 6/1982 | Güttinger | 100/153 |

FOREIGN PATENT DOCUMENTS

| | | | |
|---|---|---|---|
| 525788 | 10/1954 | Belgium | 100/154 |
| 2545624 | 4/1977 | Fed. Rep. of Germany . | |
| 327433 | 3/1958 | Switzerland . | |

*Primary Examiner*—Billy J. Wilhite
*Assistant Examiner*—Arthur D. Dahlberg
*Attorney, Agent, or Firm*—Burns, Doane, Swecker & Mathis

[57] ABSTRACT

In a double band press the compressing pressure is applied to the endless bands by pressure plates via intermediate pressure rolls. The pressure rolls extend transversely to the running direction of the steel bands and are interconnected at their ends by a guide chain. More than two pressure rolls are associated with each pair of connecting bolts of the guide chain. The axes of the pressure rolls are parallel and are offset transversely relative to the axes of the connecting bolts of the guide chain. In this manner, a stable connection of the pressure rolls among themselves is made possible, with the pressure rolls having a smaller diameter and being capable of being arranged closely adjacent to each other. A more uniform and higher distribution of pressure may be obtained thereby.

17 Claims, 14 Drawing Figures

DOUBLE BAND PRESS

BACKGROUND AND OBJECTS OF THE INVENTION

The invention concerns a double band press, wherein two endlessly revolving steel bands which receive therebetween the material to be pressed, are guided between pressure plates. A plurality of pressure rolls are arranged to transfer pressure from the pressure plates to the pressing flights of the bands in a direction transversely of the travel paths of the bands. The pressure rolls are rotatably attached at least at one end to a guide chain, the links of which chain being connected with each other by means of bolts or the like.

As noted above, it is known to arrange a plurality of pressure rolls between the steel bands and the pressure plates for the transfer of compression forces in double band presses. From Swiss Pat. PS No. 327,433 it is known that the pressure rolls can be interconnected at their ends by means of chain links or a guide chain, whereby the rolls form a roller blanket. The axes of the pressure rolls coincide with the axes of the chain bolts interconnecting the chain links. Particularly in the transfer of very high pressures, such a rotational arrangement of pressure rolls is advantageous.

In the layout of the guide chain, care must be taken to insure that the individual chain links are sufficiently strong so that even in the case of very large pressures to be transferred, the safe coherence of the pressure rolls is assured. In the known configuration, the pressure rolls are therefore at a relatively large distance from each other (depending on the given dimensions of the chain links and the division of the chains), so that the contact surfaces of the pressure rolls on the steel bands are also at a relatively large distance from each other and relatively large intermediate spaces between the pressure rolls must be accepted. In the case of very high pressures, this can lead to the overloading of the bands which results in excessive wear of the steel bands.

It is an object of the invention to eliminate the aforementioned disadvantages and to provide a double band press, wherein the pressing process may take place under high pressures, without the occurrence of undesirable overloads.

SUMMARY OF PREFERRED EMBODIMENTS OF THE INVENTION

In the present invention more than one pressure roll is associated with each pair of bolts of the guide chain. The axes of the pressure rolls extend transversely of the surface of the associated steel band, and in a mutually parallel manner. These axes are offset with respect to the axes of the bolts which interconnect the chain links. By means of this configuration, relatively large and strong chain links may be used, but the pressure rolls arranged thereon may have smaller diameters and may therefore be placed at reduced distances to each other, so that a uniform distribution of the pressure may be obtained. Even with higher pressures, the steel bands are not overloaded. The offset arrangement of the guide roll axes with respect to the pressure roll axes makes it possible to obtain small product thicknesses, since it is assured that the guide chains arranged above the working flight of the upper steel band and underneath the working flight of the lower steel band will remain at an adequate distance from each other and will not interfere with each other.

In an advantageous configuration of the invention, two pressure rolls are associated with each bolt of the guide chain. This may be obtained, for example, by equipping the links of the guide chain with a projection section with which the pressure rolls are connected. The links of the guide chain may then have the same configuration per chain segment, with two pressure rolls being fastened to each link. It is also possible, however, to equip only the outer links with a projection section, with several pressure rolls, for example three to four, being attached to the outer links of the segment.

In one embodiment, the pressure rolls are connected by means of bolts with the guide chain. These bolts are secured to the projection sections of the links of the guide chain and engage bores of the pressure rolls. But it is equally possible to fasten the terminal ends of the pressure rolls directly to the links of the guide chain.

In a particularly stable embodiment, a bearing block is fastened to the outer links facing the pressure rolls. The bearing block projects beyond the height of the guide chain, with the pressure rolls being rotatably mounted to the projection section. In this manner, an off-the-shelf guide chain may be used, to the outer links of which the bearing blocks are attached. The latter are provided with bores, into which the ends of the pressure rolls are inserted.

It may further be favorable to fasten the bearing block at a distance from the guide chain by means of a connecting element. This makes it possible to bearingly support the guide chain itself in a guide.

In another embodiment the outer links of the guide chain comprise the legs of a U-shaped strap. The bight of the strap carries a bush which receives the ends of the pressure rolls. Two receiving bores may be provided, for example, per receiving bush, into which one pressure roll may be inserted with its ends in each instance. It is advantageous in this case to taper the diameters of the terminal ends of the pressure rolls to a smaller diameter. In this manner, the receiving bush is prevented from projecting past the roll diameter in the direction of the steel band, so that the pressure rolls and the roll chains may run very close to each other, without actually interfering with each other. It is then further possible to press material to very small material thicknesses.

It is also advantageous to place the ends of the pressure rolls outside the boundary of the guide chain. In this configuration, roll guides may be arranged in a simple manner to correct the position of the pressure rolls in the guide chain. These guides may be provided, for example, in the return area of the roll assembly or in the vicinity of the reversing shaft in the form of a V-ledge or a guide wheel. The position of the pressure rolls in relation to the guide chain will then be corrected after each revolution.

But the guidance of the rolls may also be effected by means of a plurality of circumferential grooves provided on the rolls beyond the boundary of the pressure plates. These grooves are aligned with each other from pressure roll to pressure roll and cooperate with a wedge-like roll guide arranged underneath.

In the case of large widths of the pressure roll assemblies, i.e., the rolls are of long length, the pressure rolls may be divided into roll segments. The individual segments are interconnected by means of loose bolts. The individual segments may be spaced apart by locating the ends of the bolts in bore terminals of the roll segments.

The latter are provided in the pressure rolls to receive the bolts. In this manner, spacings or gaps are created between the individual roll segments in which chain links are connected with the bolts. This layout results in a roll assembly in which the risk of the bending or distortion of the pressure rolls is minimized.

The roll segments for the pressure rolls arranged above the upper steel band and underneath the lower steel band may be placed in a staggered manner. It is equally possible to arrange two links leading to an adjacent pressure roll in each gap, while a supporting roll is provided between the links, the supporting roll having a diameter corresponding to that of the pressure rolls.

THE DRAWINGS

These objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 1:
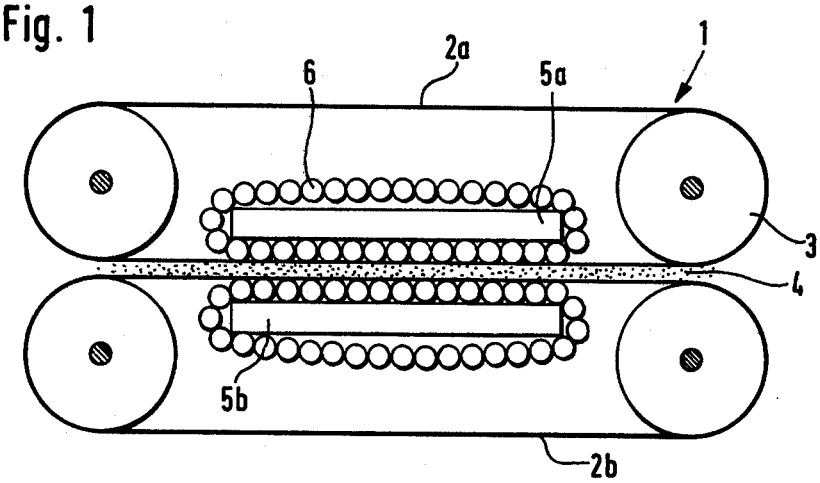
FIG. 1 is a schematic representation of a double band press with a rolling reduction assembly.

In FIG. 1, there is schematically depicted a double band press 1, operating with a reducing roll assembly 6. By means of supporting rolls 3 a pair of endless steel bands 2*a* and 2*b* are guided so as to define opposing working flights able to receive therebetween the material 4 to be pressed. The material 4 is exposed to high pressures by converging the pressure plates 5*a* and 5*b*. In order to be able to apply such pressures without interfering with the running of the bands 2*a*, 2*b*, a plurality of pressure rolls 6 are disposed between the pressure plates 5*a* and 5*b* and the corresponding steel bands 2*a* and 2*b*. The axes of the pressure rolls extend transversely to the running direction of the bands. The rolls are attached, beyond the sides of the pressure plates, to a pair of guide chains. The pressure rolls are between the moving bands and the pressure plates under a high pressure. The roll assembly established in this manner is under a high stress so that it is important to maintain it together by means of strong chain segments, because only by these means can a shifting and distortion of the pressure rolls be prevented. These relatively large chain segments, which in the prior art configurations are connected with each other through the ends of the pressure rolls, result in these known installations in large distances existing between the individual pressure rolls, whereby under very high pressures the bands may become overloaded.

According to the present invention, more than one pressure roll is associated with each connecting location of the links of a guide chain. Stated another way, the ratio of the quantity of rolls 6 to the quantity of fastening pins 10*a* of each chain 19 is greater than 1:1. Thus, with pressure rolls 7 of a relatively small diameter a roll assembly may be formed, which is capable of effecting a highly uniform transfer of pressure, while retaining adequate stability, as the chain links may be laid out independently.

Figure 2:
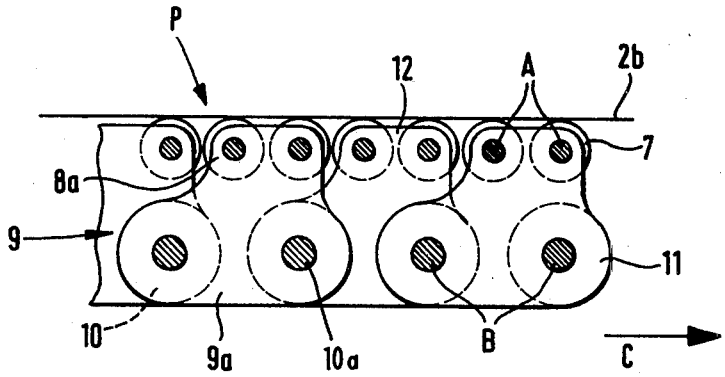
FIG. 2 is a side elevational view of a segment of a roll-carrying chain according to the invention.
Figure 3:
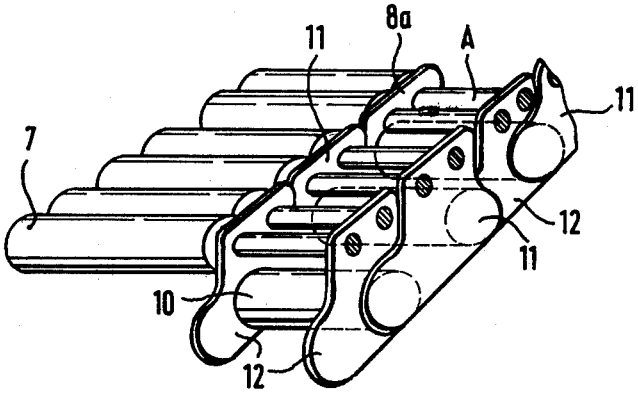
FIG. 3 is a perspective view of the chain segment depicted in FIG. 2.

In the configuration shown in FIG. 2, a lateral view of a section of one of the guide chains 9 according to the invention is displayed. The chain 9 comprises two segments, each segment including alternating outer and inner links 11, 12. The links of each segment are connected in series to each other and in parallel to the links of the other segment by means of bolts 10*a* which extend through auxiliary spacer rolls 10 (see also FIG. 3). Each outer link 11 and each inner link 12 includes a projection section 8*a*, which extends beyond the peripheries of the auxiliary rolls 10 in a direction transversely to the working flight of the associated steel band 2*b*. The pressure rolls 7 are rotatably attached to those sections 8*a*. Thus, the axes A of the pressure rolls 7 are offset with respect to the axes B of the bolts 10*a* in a direction transversely of the planes of the working flights of the steel bands 2*b*. As a result, the size of the links can be determined independently of the diameter of the pressure rolls and can be varied without concern that the guide chain will project beyond the plane formed by the steel bands. The pressure rolls 7 are tapered-off at their ends inserted in the sections 8*a*, with two pressure rolls being fastened to each pair of links.

It will be appreciated that at least two rollers 7 are connected to a given link 11 or 12, without being connected to an adjacent series-connected link. That is, the rollers are not connected simultaneously to two of the links as has heretofore been common, wherein the rollers are coaxial with or define the fasteners between series-connected ones of the links.

Figure 4:
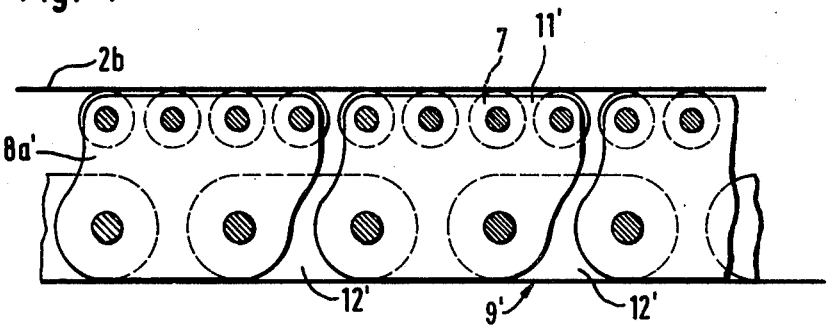
FIG. 4 is a view similar to FIG. 2 of a modified chain according to the invention.

In another embodiment of the invention (FIG. 4) the pressure rolls 7 are mounted only in the outer links 11' of the guide chain 9'. Here, the projecting section 8*a'* is provided on the outer links only and is designed so that it has sufficient space for the articulation of, for example, four pressure rolls. No pressure rolls are arranged on the inner links 12' of the chain segments.

Figure 5:
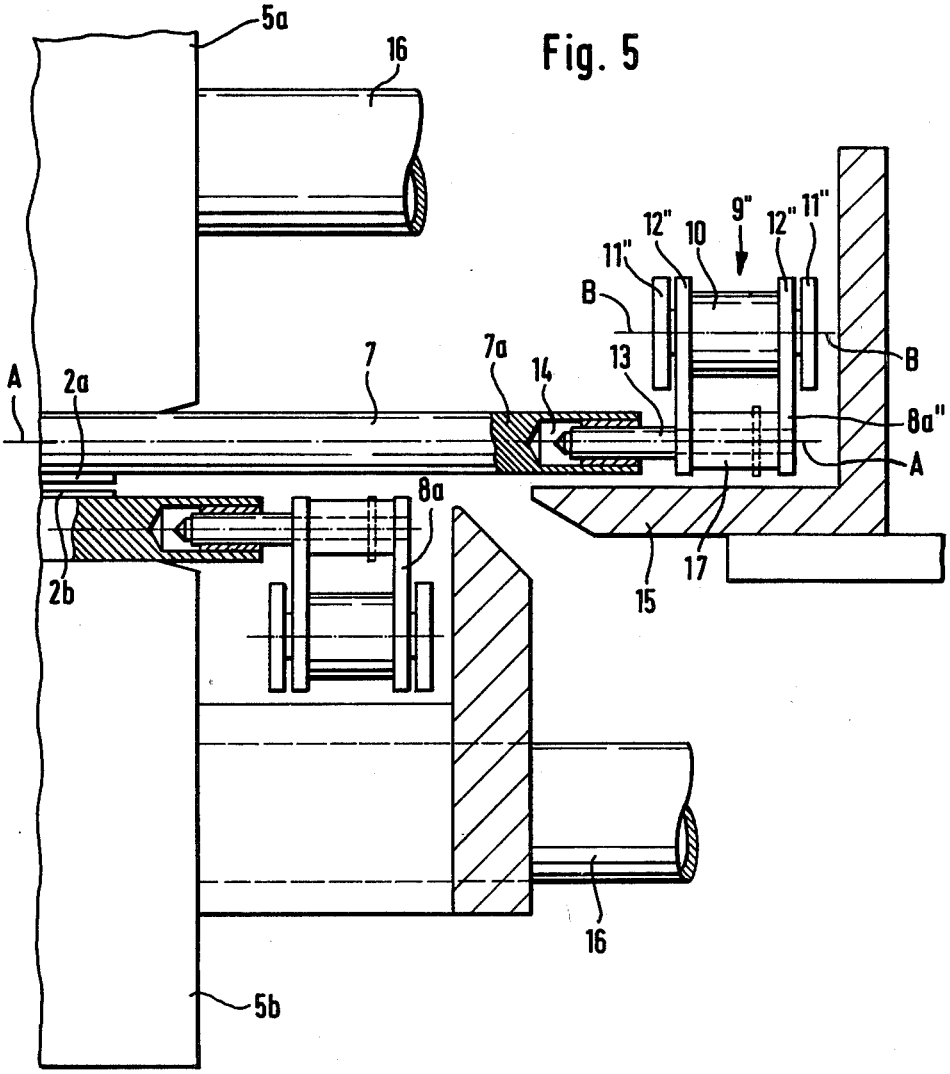
FIG. 5 is a partial cross-sectional view taken through the periphery of a double band press according to the invention, depicting another form of the roll-carrier.

Different embodiments of the rotatable attachment of the pressure rolls 7 to the guide chain 9 are possible. Thus, for example, FIG. 5 shows an embodiment wherein the guide chain 9'' is equipped with projecting sections 8*a''* only on the inner links 12'', with a bearing bush 17 extending between the projecting section 8*a''* of the inner links 12'', which bearing bush serves to receive a bolt or pin 13. Here again, several bearing bushes 17 or one bearing bush with several bores are provided to receive the bolts 13, per chain segment.

In this embodiment, the terminal area *7a* of the pressure rolls 7 is equipped with a bore 14, in which the bolts 13, connected with the guide chain 9'' are inserted. By means of the guide angle member 15, it may be made certain that following the placement of the chain on the pressure rolls, the latter will not release the rolls.

The pressure plates 5a and 5b may be heated or cooled by means of supply lines 16. If the bands 2a and 2b are set in motion, the pressure rolls 7 roll between the pressure plates and the bands, with the fixation and coherence of the pressure rolls 7 being assured by means of the guide chain 9, 9', 9'' even in the case of very high pressures. The axes A—A of the pressure rolls 7 and the axes B—B of the auxiliary rolls 10 are arranged in all of the forms of embodiment offset with respect to each other in an axially parallel manner, transversely to the running direction C, wherein the size of the auxiliary rolls 10 may be chosen independently of the diameter of the pressure rolls.

Figure 6:
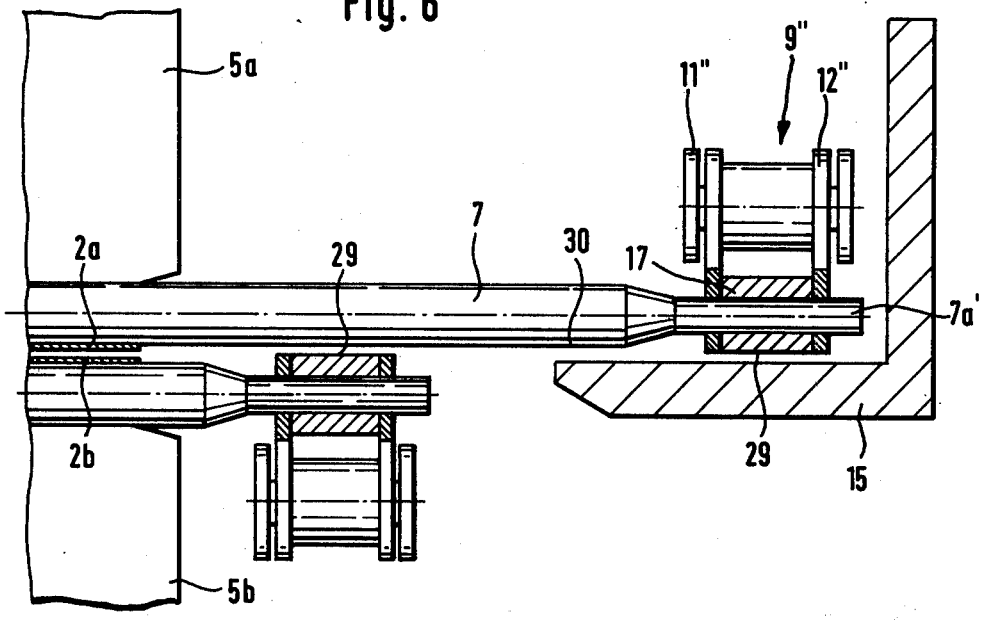
FIG. 6 is a view similar to FIG. 5 of yet another form of the roll-carrier according to the invention.

In a further example of embodiment, as shown in FIG. 6, the terminal sections *7a'* of the pressure rolls 7 are tapered and are inserted into the bearing bushes 17 in the guide chain 9'', which bushes 17 are mounted between the inner links 12'' of the guide chain 9''. To install the guide chain 9'', it is merely slid onto the terminal sections *7a*. Sliding-off of the guide chain 9'' may be prevented by the guide angle member 15. It is advantageous in this case not to let the end rims 29 of the inner links 12'' and of the bearing bushes 17 project past the bearing edge 30 of the pressure rolls 7 toward the steel bands 2a and 2b. It is then possible to bring the pressure rolls of the upper and lower band very closely together so that even small product thicknesses may be processed. By extending the pressure rolls 7 of the top roll assembly laterally beyond the pressure rolls 7 of the bottom roll assembly (FIG. 6), sufficient space is provided for the mounting of guides for the guide chain 9'', such as for example the guide angle 15, without mutual interference.

Figure 7:
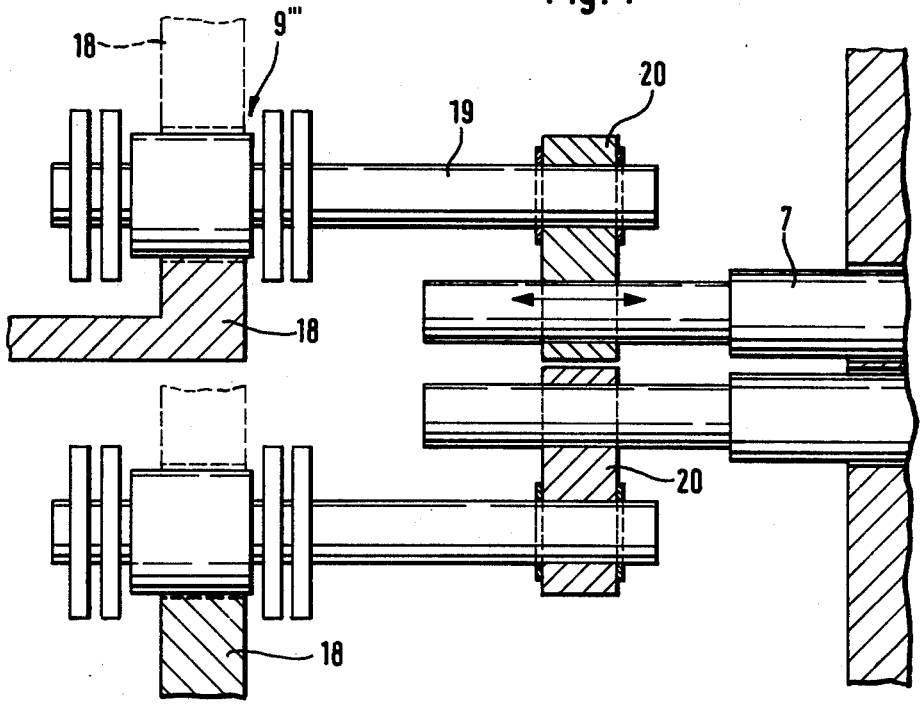
FIG. 7 is a view similar to FIG. 5 of still another roll-carrier arrangement.
Figure 8:
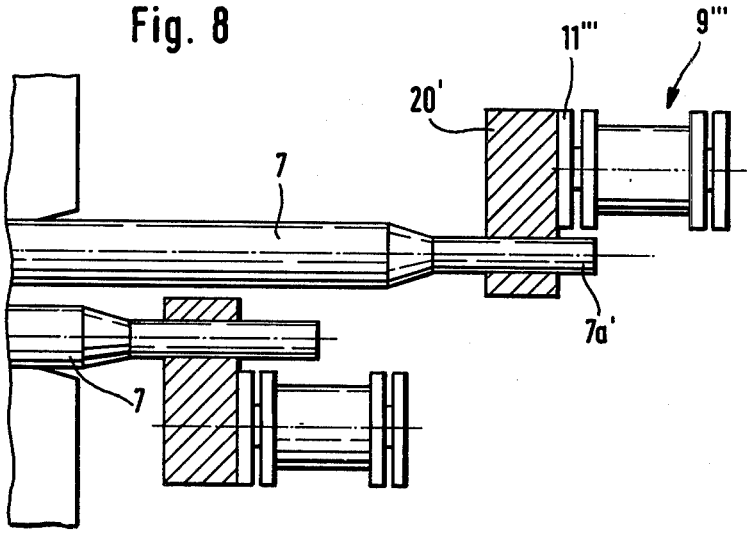
FIG. 8 is a view similar to FIG. 5 of a further type of roll-carrier arrangement.

If a more effective guidance of the guide chain is considered necessary, it may be effected by means of a roll guide 18, as shown in FIG. 7. From a conventional guide chain 9''', a connecting element 19 extends to a bearing block 20, which is equipped with receiving bores for the terminal sections of the pressure rolls 7. The bearing block is held spaced from the chain as shown in the embodiment of FIG. 8. Hence, the pressure rolls 7 are again held in a bearing block 20', which is fastened to the outer link 11''' of the guide chain 9'''. The bearing block is again designed so that it is capable of holding several pressure rolls 7.

Figure 9:
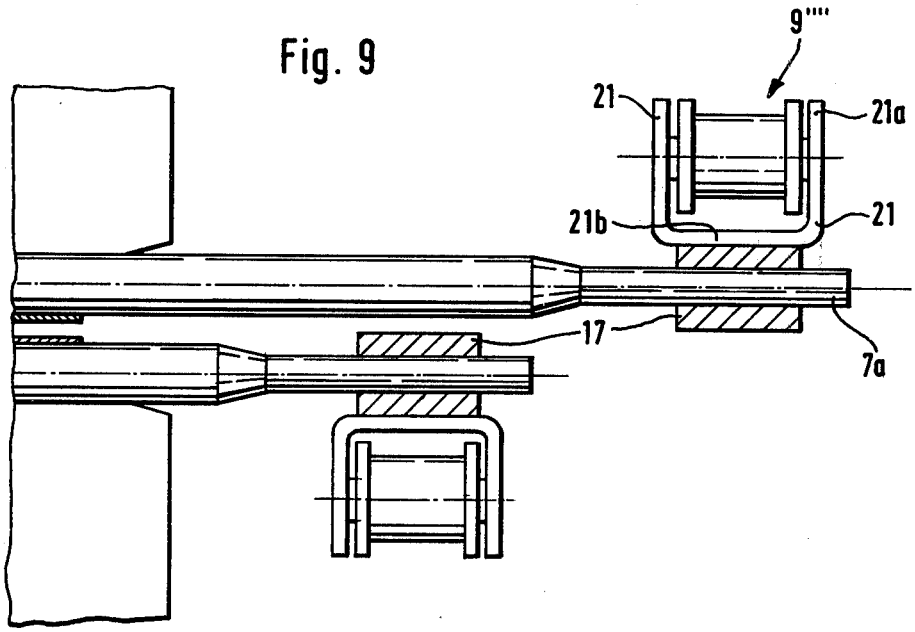
FIG. 9 is a view similar to FIG. 5 of still another roll-carrier arrangement.

It is, however, also possible to effect an articulated joint such as that shown in FIG. 9. Here, the outer links of the guide chain 9''' are in the form of legs 21a of a strap 21, upon the bight 21b of which a bearing bush 17 is mounted. This yields a highly stable guide chain 9'''.

Figure 10:
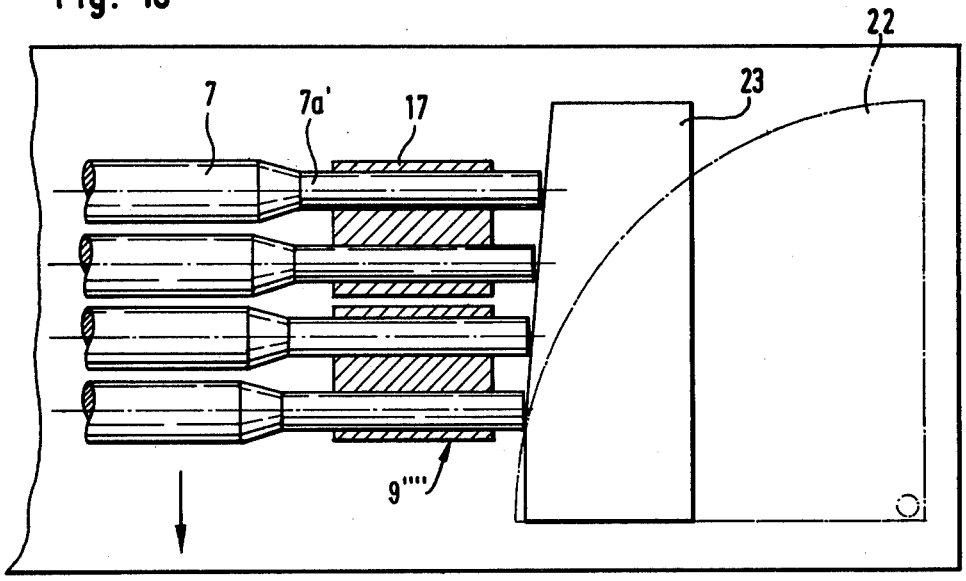
FIG. 10 depicts a portion of a roll assembly in top plan, together with means for reorienting the rolls.
Figure 11:
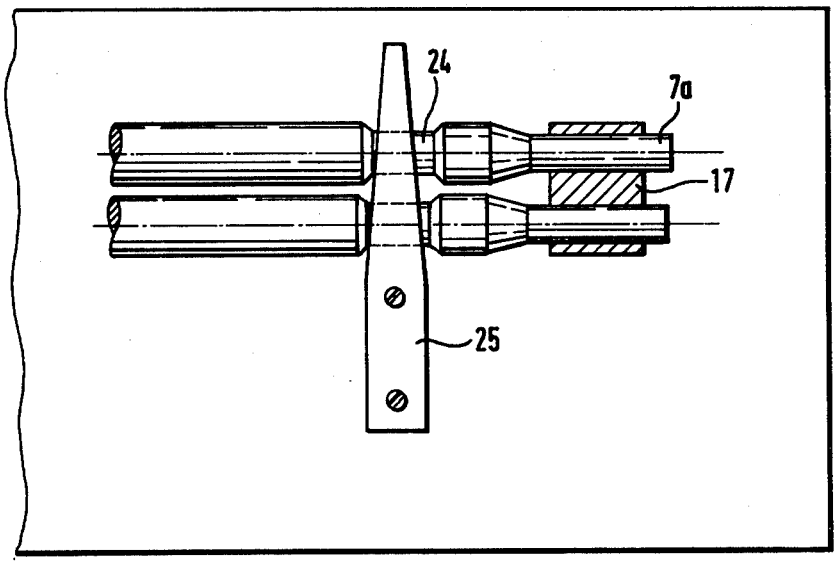
FIG. 11 is a view similar to FIG. 11 of a different type of reorienting means.

Since the connection between the guide chains and the pressure rolls are resilient in the direction of the floating axles (i.e., the pressure rolls are freely slidable longitudinally within the guide chain), it is advantageous to correct the location of the pressure rolls with respect to the guide chain after each revolution by means of roll guides. This may be effected for example by means of a fixed abutment in the form of a guide ledge 23, as shown in FIG. 10. The terminal sections *7a'* of the pressure rolls 7 are long enough here, so that they are projecting past the boundary of the guide chain, of which two bearing parts 17 are shown (e.g., the form of chain embodiment of FIG. 9). The terminal sections *7a'* contact the guide ledge 23 during the travel of the rolls, which are then displaced correspondingly in relation to the guide chain. The same effect may be obtained by means of an abutment in the form of a curved guide surface 22, a section of which is shown by a broken line in FIG. 10. A further type of roll guidance may comprise grooves 24 extending circumferentially around the part of the pressure rolls 7 projecting past the pressure plates; with the grooves cooperating with an abutment in the form of a wedge-shaped roll guide 25. The grooves 24 and guide 25 act in cooperation to align the pressure rolls after each revolution in relation to each other (FIG. 11).

Figure 12:
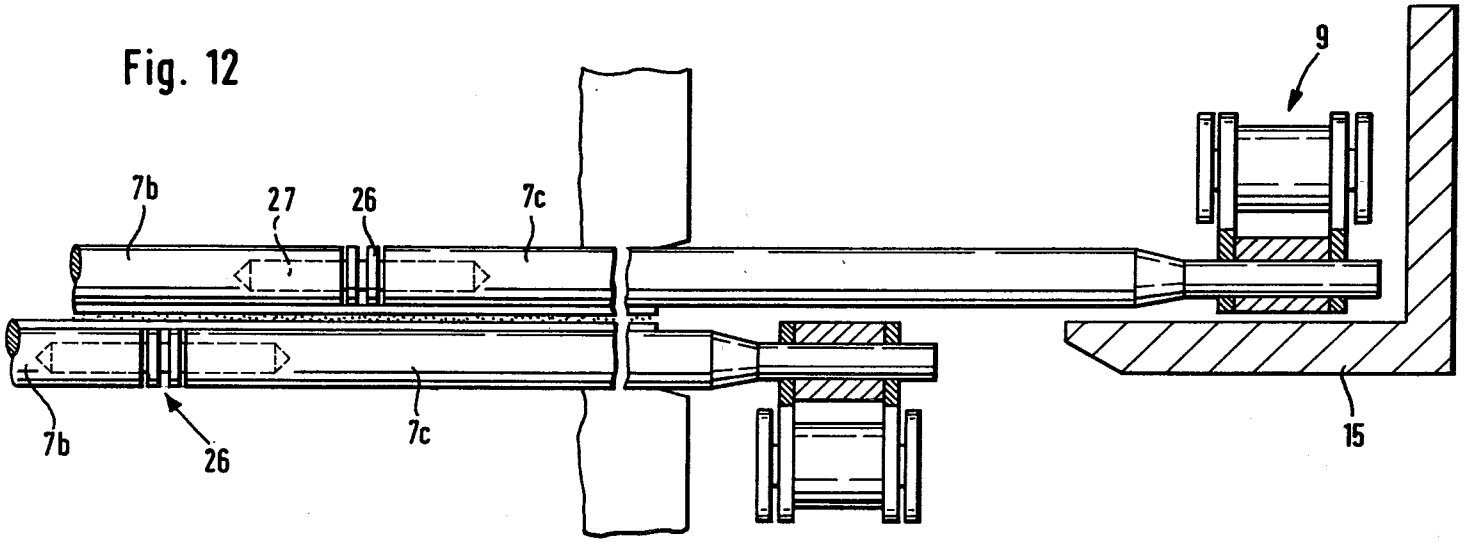
FIG. 12 is a partial cross-sectional view taken through the periphery of a double band press depicting pressure rolls divided into segments.
Figure 13:
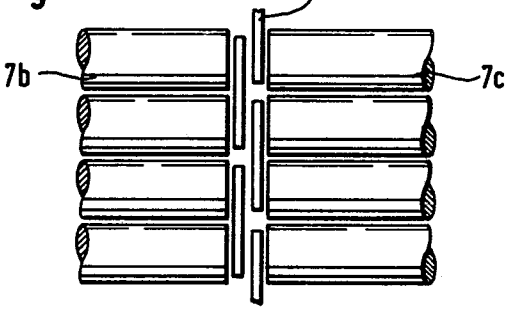
FIG. 13 depicts, in top plan view, a fragment of the arrangement depicted in FIG. 12.

If a roll assembly is desired that is especially stable in its dimensions when passing between the pressure plates, it is advantageous to divide the pressure rolls into individual segments *7b* and *7c* interconnected by means of loose bolts 27 (FIG. 12). The bolts 27 are introduced into bores in the terminal sections of the pressure rolls, wherein they abut against the ends of the bores, thereby maintaining a certain spacing between the individual segments. Links 26 may be disposed in these spacings, making possible the interconnection of adjacent rolls in the manner shown in FIG. 13.

Figure 14:
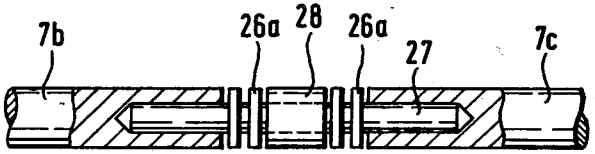
FIG. 14 depicts in partial cross-section a connection between two pressure roll segments.

If a particularly stable joining of adjacent rolls is desired, two pairs of links 26a may be arranged between the segments *7b, 7c*, the pairs being separated by a support roll 28 having the same diameter as the pressure roll segments *7b* and *7c* (FIG. 14). This results in a particularly stable roll assembly, highly secure against bending and distortion.

As noted earlier, more than one pressure roll is associated with each connecting location of the chain links. That is, in the case where a pressure roll is mounted coaxially with a bolt that interconnects adjacent chain links, the total number of pressure rolls will equal the total number of links (i.e., there will be one pressure roll per link). In the present invention, however, where more than one pressure roll is mounted on each link at a location offset from the connecting bolts, there will be more than one pressure roll per link.

In all of the forms of embodiment, several pressure rolls of a small diameter are articulated on a chain segment, whereby a denser roll assembly is obtained. Accordingly, the risk of band overloading is no longer present in the case of very high pressures.

Although the present invention has been described in connection with preferred embodiments thereof, it will be appreciated by those skilled in the art that additions, modifications, substitutions, and deletions may be made, without departing from the spirit and scope of the invention, as defined in the appended claims.

What is claimed is:

1. A double band press comprising:

a pair of endless metal bands arranged such that a working flight of each band travels opposite a working flight of the other band to press material therebetween, a pair of pressure plates, each positioned adjacent respective ones of said working flights, a pair of pressure roller assemblies positioned adjacent respective ones of said pressure plates, each pressure roller assembly comprising:

a plurality of pressure rollers arranged to travel between one of said pressure plates and its respective metal band to transmit pressure from the former to the latter, the axes of said pressure rollers being oriented perpendicular to the direction of band travel, and a pair of guide chains disposed on opposite sides of the respective pressure rollers and connected to respective ends of each of said presure rollers, each guide chain comprising a plurality of links interconnected in series by means of pins, at least some of said links being connected to said ends of said pressure rollers at locations offset from said fasteners in a direction generally transverse to the plane of the working flight of the associated band, the ratio of the quantity of said rollers to the quantity of said pins in each chain being greater than 1:1.

2. A double band press according to claim 1, wherein said links to which said pressure rollers are connected include lateral projections to which the pressure rollers are connected.

3. A double band press according to claim 1, wherein said links include alternating inner and outer links, with only said outer links being connected to said ends of said pressure rollers.

4. A double band press according to claim 1, wherein said rollers are connected to said links by means of bolts which project from said links and are received in longitudinal bores of said pressure rollers.

5. A double band press according to claim 1, wherein said ends of said pressure rollers are of reduced diameter and are received in said links.

6. A double band press according to claim 1, wherein bearing blocks are mounted on at least some of said links, said rollers being connected to said bearing blocks.

7. A double band press according to claim 6, wherein a plurality of connecting elements are mounted to each of said guide chains, said connecting elements carrying said bearing blocks and positioning said bearing blocks away from the associated guide chain.

8. A double band press according to claim 1, wherein each said chain comprises a pair of sections, each section comprising alternating outer and inner links, said outer link of one section being interconnected by a bight member to form a U-shaped stirrup with said outer links forming the parallel legs of said stirrup, a bearing bush being mounted to said bight member and receiving an end of one of said pressure rollers.

9. A double band press according to claim 1, wherein the ends of said pressure rolls extend beyond the sides of the respective band.

10. A double band press according to claim 1, including abutment means arranged to engage said pressure rollers and slide same axially relative to said guide chains to orient said pressure rollers in a preselected manner relative to said guide chains.

11. A double band press according to claim 10, wherein said abutment means comprises a straight surface against which the ends of said pressure rollers engage.

12. A double band press according to claim 10, wherein said abutment means comprises a curved surface against which the ends of said pressure rollers engage.

13. A double band press according to claim 10, wherein each pressure roller includes a groove, said abutment means comprising a surface receivable within said grooves.

14. A double band press according to claim 1, wherein each of said pressure rollers comprise a plurality of coaxial segments, said segments being loosely interconnected by bolts which permit relative movement between said segments.

15. A double band press according to claim 14, including auxiliary links positioned in a space between said segments and interconnecting adjacent ones of said pressure rollers.

16. A double band press according to claim 15, wherein at least two auxiliary links are disposed in each space, a supporting roll being positioned in said space between said auxiliary links, said supporting roll being coaxial with said segments of the associated pressure roller and being of the same diameter as said segments.

17. A double band press according to claim 14, wherein the joints between said segments of one of said pressure roller assemblies are offset relative to the joints between said segments of the other of said pressure roller assemblies in the axial direction of said pressure rollers.

* * * * *